US007751747B2

(12) United States Patent
Lee et al.

(10) Patent No.: US 7,751,747 B2
(45) Date of Patent: Jul. 6, 2010

(54) PROCESS CARTRIDGE UNIT AND IMAGE FORMING APPARATUS HAVING THE SAME

(75) Inventors: Jun Ho Lee, Seoul (KR); Dong Hoon Park, Osan-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 203 days.

(21) Appl. No.: 12/134,507

(22) Filed: Jun. 6, 2008

(65) Prior Publication Data

US 2008/0317500 A1 Dec. 25, 2008

(30) Foreign Application Priority Data

Jun. 20, 2007 (KR) ..... 10-2007-0060208
May 14, 2008 (KR) ..... 10-2008-0044254

(51) Int. Cl.
*G03G 21/16* (2006.01)

(52) U.S. Cl. ..... 399/111

(58) Field of Classification Search ..... 399/110, 399/111, 112, 113, 114
See application file for complete search history.

(56) References Cited

U.S. PATENT DOCUMENTS 5,047,803 A * 9/1991 Kanoto ..... 399/111
7,330,679 B2 * 2/2008 Kweon ..... 399/111
2005/0238386 A1 * 10/2005 Baek ..... 399/114
2006/0045567 A1 * 3/2006 Ahn et al. ..... 399/111
2006/0159486 A1 7/2006 Kweon

FOREIGN PATENT DOCUMENTS

JP 2002-328586 11/2002

* cited by examiner

*Primary Examiner*—David P Porta
*Assistant Examiner*—Kiho Kim
(74) *Attorney, Agent, or Firm*—Staas & Halsey LLP

(57) ABSTRACT

A process cartridge unit and an image forming apparatus having the same. The image forming apparatus includes a main body, a process cartridge unit removably mounted in the main body, an opening provided in the main body to permit the process cartridge unit to be installed or removed, and a cover rotatably mounted to the main body so as to expose or shield the opening. The process cartridge unit includes a container to store a developer and at least one knob coupled to the container. When the cover is closed, the knob is folded by the cover, and when the cover is opened, the knob is unfolded. Accordingly, since the position of the knob is changed, a mounting space of the process cartridge unit can be decreased, and a user can easily grasp the knob.

27 Claims, 9 Drawing Sheets

PROCESS CARTRIDGE UNIT AND IMAGE FORMING APPARATUS HAVING THE SAME

CROSS-REFERENCE TO RELATED APPLICATION

This application claims all benefits accruing under 35 U.S.C. §119 from Korean Patent Application Nos. 2007-60208 and 2008-44254, filed in the Korean Intellectual Property Office on Jun. 20, 2007 and May 14, 2008, the disclosure of which is incorporated herein by reference.

BACKGROUND OF THE INVENTION

1. Field of the Invention

Aspects of the present invention relate to an image forming apparatus, and more particularly, to a process cartridge unit and an image forming apparatus having the same which can change a position of a knob.

2. Related Art

An electrophotographic type image forming apparatus, such as a laser printer, a copying machine, a fax machine, or a multifunction device, is configured to develop an electrostatic latent image into a visible image by supplying a developer to a surface of a photosensitive body, transfer the visible image onto a printable medium, and fuse the visible image to the printable medium. Such an image forming apparatus generally includes a photosensitive drum, a developing roller, and a developer container storing a developer.

The developer is a consumable article, and a photosensitive drum or a developing roller has a lifespan shorter than other components. In order to replace the above components easily, recently-developed image forming apparatuses employ a process cartridge unit in which the above components integrated into a single unit. In other words, the above consumable components can be replaced all at once only by replacing the process cartridge unit.

The image forming apparatus equipped with such a process cartridge unit includes a main body provided with an opening to install or remove the process cartridge unit and a cover to expose or shield the opening. The process cartridge unit is provided with a knob that enables a user to install or remove the process cartridge unit easily.

However, because the size (or the length) of the process cartridge unit is large due to the process cartridge unit's knob, the conventional image forming apparatus requires a large space in the main body to accommodate the process cartridge unit. Therefore, it is difficult to decrease the size of the main body. Further, when removing the process cartridge unit from the main body, a user must reach into the main body to grasp the knob.

SUMMARY OF THE INVENTION

Aspects of the present invention provide a process cartridge unit and an image forming apparatus having the same that is configured to change a position of a knob, thereby minimizing the size of the process cartridge unit and/or the image forming apparatus.

Additional aspects of the present invention provide a process cartridge unit and an image forming apparatus having the same that enables a user to grasp the knob easily.

Additional aspects and/or advantages of the invention will be set forth in part in the description which follows and, in part, will be obvious from the description, or may be learned by practice of the invention.

In accordance with an aspect of the invention, a process cartridge unit of an image forming apparatus is provided. The process cartridge unit comprises a container to store a developer; and at least one knob coupled to the container. When a cover of the image forming apparatus is closed to shield an opening in the image forming apparatus, the knob is folded by the cover, and when the cover is opened, the knob is unfolded. The process cartridge unit is removably mounted in the image forming apparatus so as to be installed or removed through the opening provided in the image forming apparatus.

According to another aspect of the invention, when the cover is opened, the knob unfolds through the opening to the exterior of the image forming apparatus.

According to another aspect of the invention, the knob is pivotably coupled to the container, and when the cover is opened, the knob rotates to unfold out by the knob's own weight.

According to another aspect of the invention, the knob is provided with a shaft coupling portion pivotably coupled to the container. The shaft coupling portion is provided with an elastic member so as to rotate the knob in an unfolding direction.

According to another aspect of the invention, the knobs are provided at each of two side portions of the container.

According to another aspect of the invention, an image forming apparatus is provided. The image forming apparatus comprises a main body; a process cartridge unit removably mounted in the main body and including a container to store a developer and at least one knob coupled to the container; an opening provided in the main body to mount the process cartridge unit; and a cover to expose or shield the opening. When the cover is closed, the knob is folded by the cover, and when the cover is opened, the knob is unfolded.

According to another aspect of the invention, a process cartridge unit mounted in an image forming apparatus is provided. The image forming apparatus includes a main body and a cover hingedly coupled to the main body. The process cartridge unit comprises a frame and at least one knob rotatably mounted to the frame. The knob is rotated interlockingly with opening/closing operation of the cover.

According to another aspect of the invention, an image forming apparatus is provided. The image forming apparatus comprises a main body having an opening, a cover to expose or shield the opening and a process cartridge unit mounted in the main body through the opening. The process cartridge unit includes at least one knob which is rotated interlockingly with opening/closing operation of the cover.

In addition to the example embodiments and aspects as described above, further aspects and embodiments will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1:
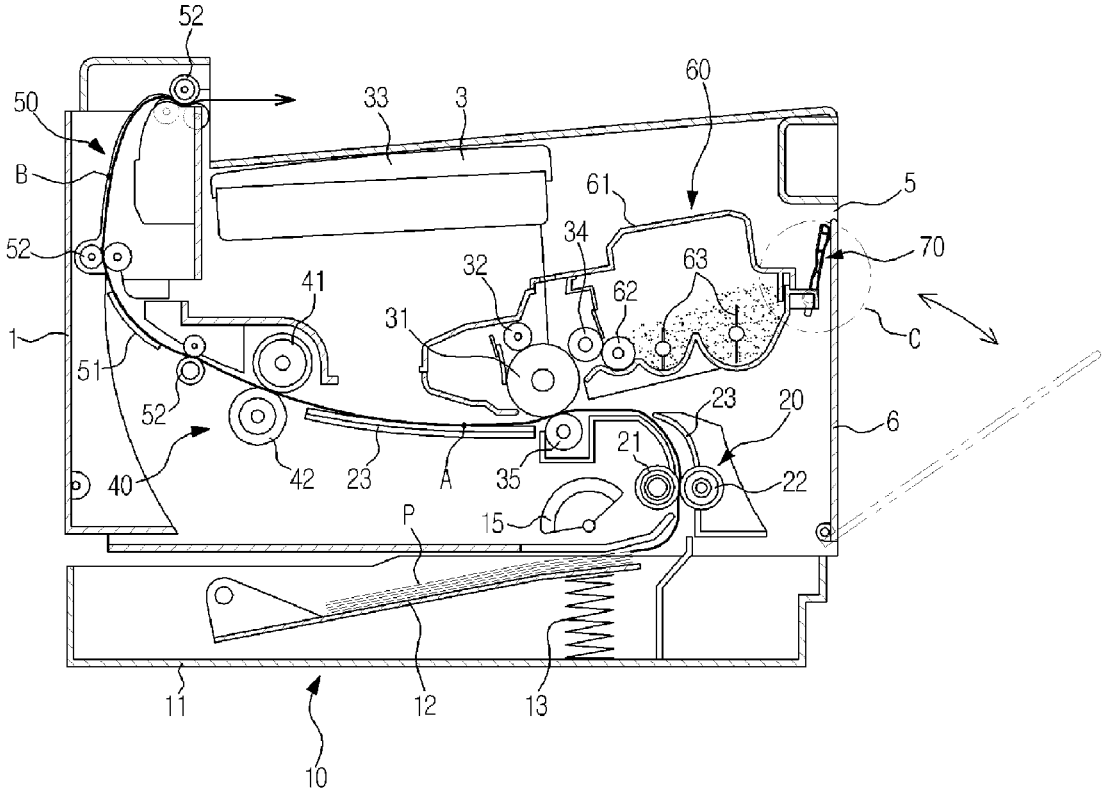
FIG. 1 is a sectional view illustrating an image forming apparatus having a process cartridge unit according to an example embodiment of the present invention.

Reference will now be made in detail to present embodiments of the present invention, examples of which are illustrated in the accompanying drawings, wherein like reference numerals refer to the like elements throughout. The embodiments are described below in order to explain the present invention by referring to the figures.

FIG. 1 shows an image forming apparatus according to an example embodiment of the present invention. The image forming apparatus includes a paper supply unit 10 to load a printable medium P thereon, a feed unit 20 to feed the printable medium P, an image forming unit to form an image on the printable medium P, a fusing unit 40 to fuse the transferred image to the printable medium P, and a paper discharge unit 50 to discharge the printable medium P. According to other aspects of the invention, the image forming apparatus may include additional and/or different units. Similarly, the functionality of two or more of the above units may be combined into a single unit.

The paper supply unit 10 is mounted in a lower portion of a main body 1. The paper supply unit 10 includes a cassette-type paper tray 11, a press plate 12, and a press spring 13, which presses the printable medium P in the paper tray 11 to a pickup roller 15 disposed above the paper tray 11. The press spring 13 is mounted under the press plate 12, and biases the press plate 12 toward the pickup roller 15. The pickup roller 15 picks up the printable medium P sheet by sheet by rotation, and supplies the printable medium P to the feed unit 20. The feed unit 20 feeds the printable medium P picked up by the pickup roller 15 to a print path A. The feed unit 20 includes a feed roller 21, a feed backup roller 22, and a feed guide 23, which forms the print path A.

The image forming unit includes a photosensitive roller 31 positioned in the print path A, a charge roller 32, a laser scanning unit (LSU) 33, a developing roller 34, and a transfer roller 35. The charge roller 32 charges the photosensitive roller 31. The laser scanning unit (LSU) 33 irradiates a laser beam to the charged photosensitive roller 31 according to an image signal so as to form an electrostatic latent image on the surface of the photosensitive roller 31. The developing roller 34 supplies a developer to the electrostatic latent image formed on the photosensitive roller 31 to form a visible image, and the transfer roller 35 transfers the visible image formed on the photosensitive roller 31 onto the printable medium P. The photosensitive roller 31 charged by the charge roller 32 has a negative charge. The electrostatic latent image is formed on the surface of the photosensitive roller 31 by the laser beam irradiated from the LSU 33. The developing roller 34 supplies the developer having a negative charge to the electrostatic latent image on the photosensitive roller 31 to form the visible image. The transfer roller 35 having a positive charge transfers the developer adhering to the photosensitive roller 31 onto the printable medium P.

The fusing unit 40 includes a heat roller 41 and a press roller 42. While the printable medium P passes between the heat roller 41 and the press roller 42, the fusing unit 40 applies heat and pressure to the developer (image) transferred onto the printable medium P so that the developer is fused to the printable medium P. The paper discharge unit 50 feeds the printable medium P, which has passed by the fusing unit 40, to a paper discharge part 3 provided on an upper portion of the main body 1. The paper discharge unit 50 includes a discharge guide member 51 that guides the printable medium P to the paper discharge part 3, and plural discharge rollers 52 disposed in a discharge path B.

As shown in FIG. 1, the image forming apparatus of this example embodiment is configured such that the photosensitive roller 31 and the charge roller 32 are integrated into the process cartridge unit 60. A frame 61*a* functioning as a container 61 stores the developer, the developing roller 34 supplying the developer to the photosensitive roller 31, feed blades 62 and 63 mounted in the container 61 to feed the developer, the photosensitive roller 31 and the charge roller 32 are integrated into the process cartridge unit 60. Accordingly, when the process cartridge unit 60 is replaced, the photosensitive roller 31 and the charge roller 32 are also replaced.

As shown in FIG. 1, the process cartridge unit 60 contains the photosensitive roller 31 and the charge roller 32. However, the process cartridge unit 60 is not limited to this configuration. Although not shown in the drawings, the process cartridge unit 60 may be configured such that the container, the developing roller 34, and the feed blades 63, which are directly related to the developer supply, are integrated into the process cartridge unit 60, and the photosensitive roller 31 and the charge roller 32 are not. The process cartridge unit 60 may also be configured such that the developing roller and the container storing the developer are provided separately from the container to supplement the developer. Only the container to supplement the developer may be separated from the main body.

As shown in FIG. 1, the main body 1 is provided with an opening 5 to replace the process cartridge unit 60 and a cover 6 to expose or shield the opening 5 at a side surface. The cover 6 is hingedly coupled to the main body 1 at a lower end so as to pivot vertically to expose or shield the opening 5. When replacing the process cartridge unit 60, the cover 6 pivots to an opened position, and the process cartridge unit 60 is removed through the opening 5.

Figure 2:
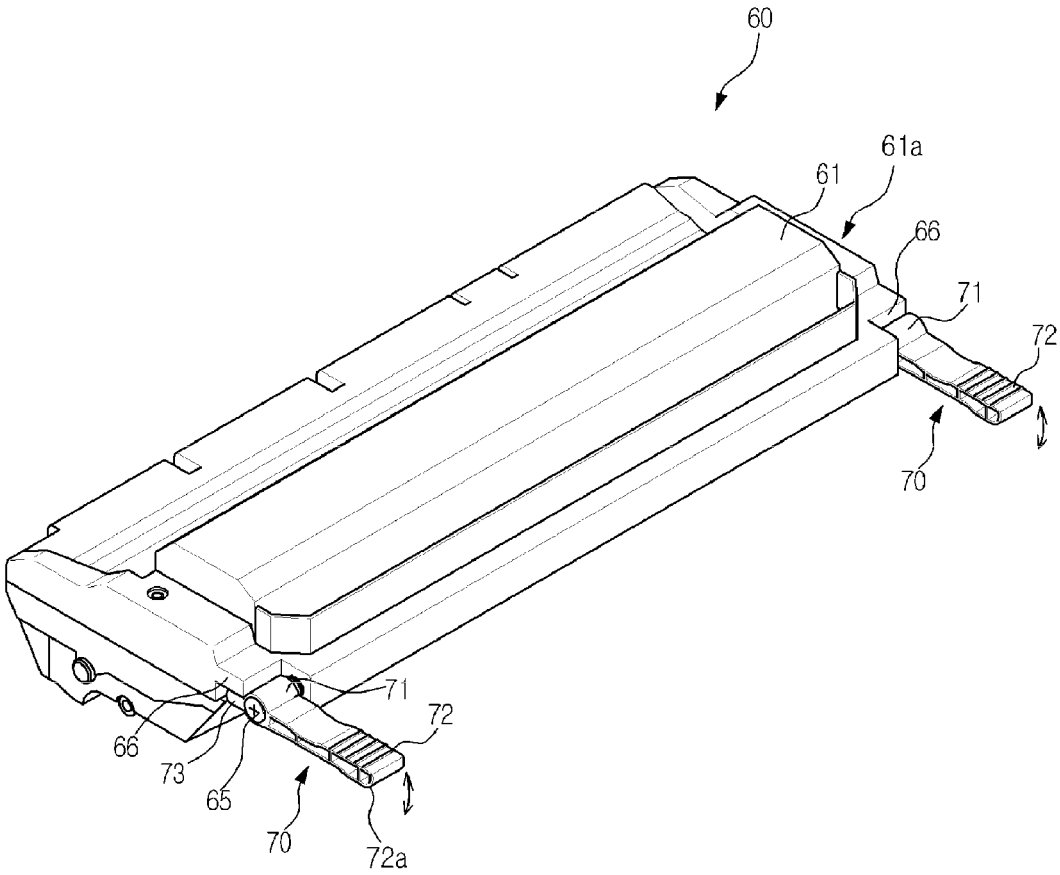
FIG. 2 is a perspective view illustrating the process cartridge unit according to an example embodiment of the present invention.
Figure 3:
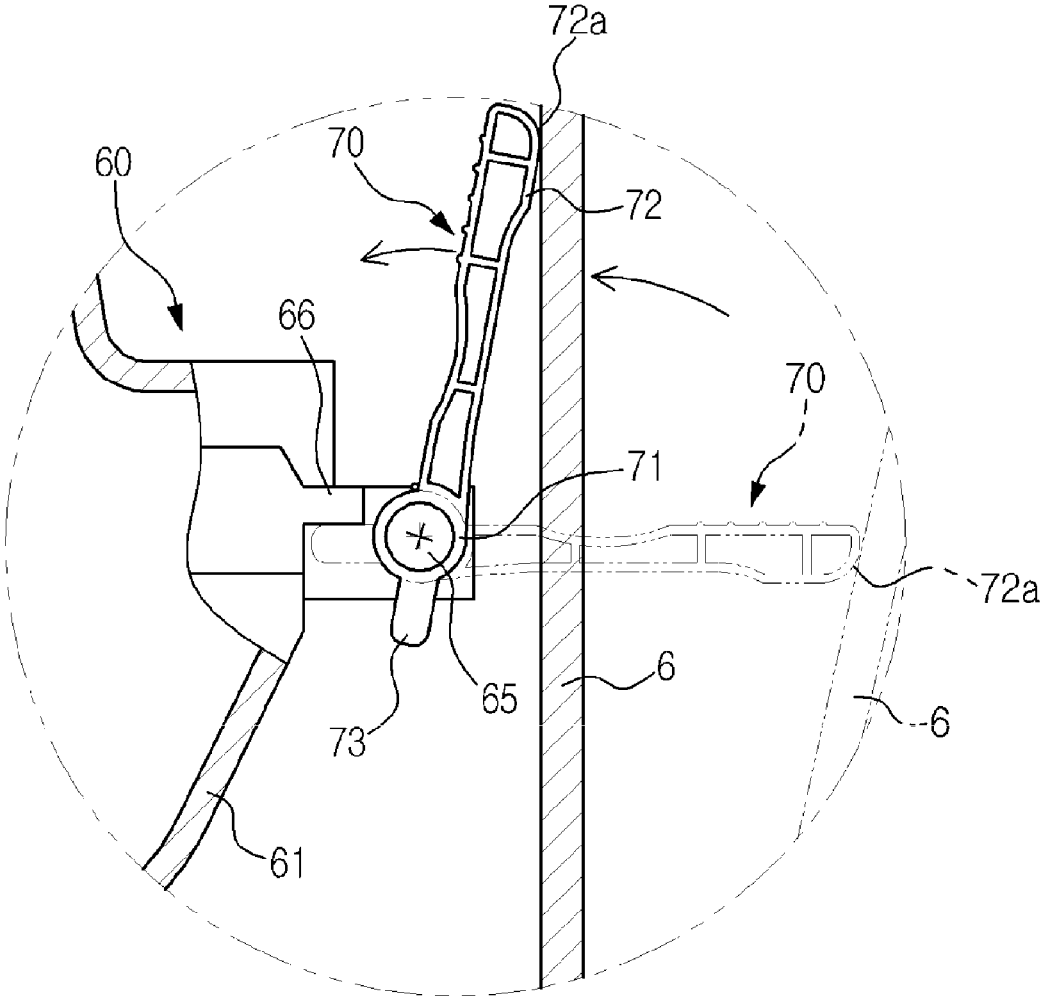
FIG. 3 is a detailed view of a C portion in FIG. 1 when a cover is in a closed state.

As shown in FIG. 2, the process cartridge unit 60 has knobs 70 provided at both side portions. This is to enable a user to easily grasp the knobs 70 and remove the process cartridge unit 60 from the main body 1. As shown in FIGS. 2 and 3, each of the knobs 70 includes a shaft coupling portion 71 pivotably coupled to a shaft 65 provided at each of the both side portions of the container 61, a grip portion 72 that extends from the shaft coupling portion 71 by a predetermined length, and a stopper portion 73 that extends from the shaft coupling portion 71 in a direction opposite to the extending direction of the grip portion 72. With this configuration, the knob 70 can rotate vertically with respect to the container 61.

The grip portion 72 may be provided with a circular arc-shaped guide surface 72*a* at a front end portion thereof, which is contacted with the cover 6. When the cover 6 starts pushing up the knob 70 (refer to an imaginary line in FIG. 3), the guide surface 72*a* guides the movement of the grip portion 72 so that the grip portion 72 can smoothly slide in contact with the inner surface of the cover 6.

Figure 4:
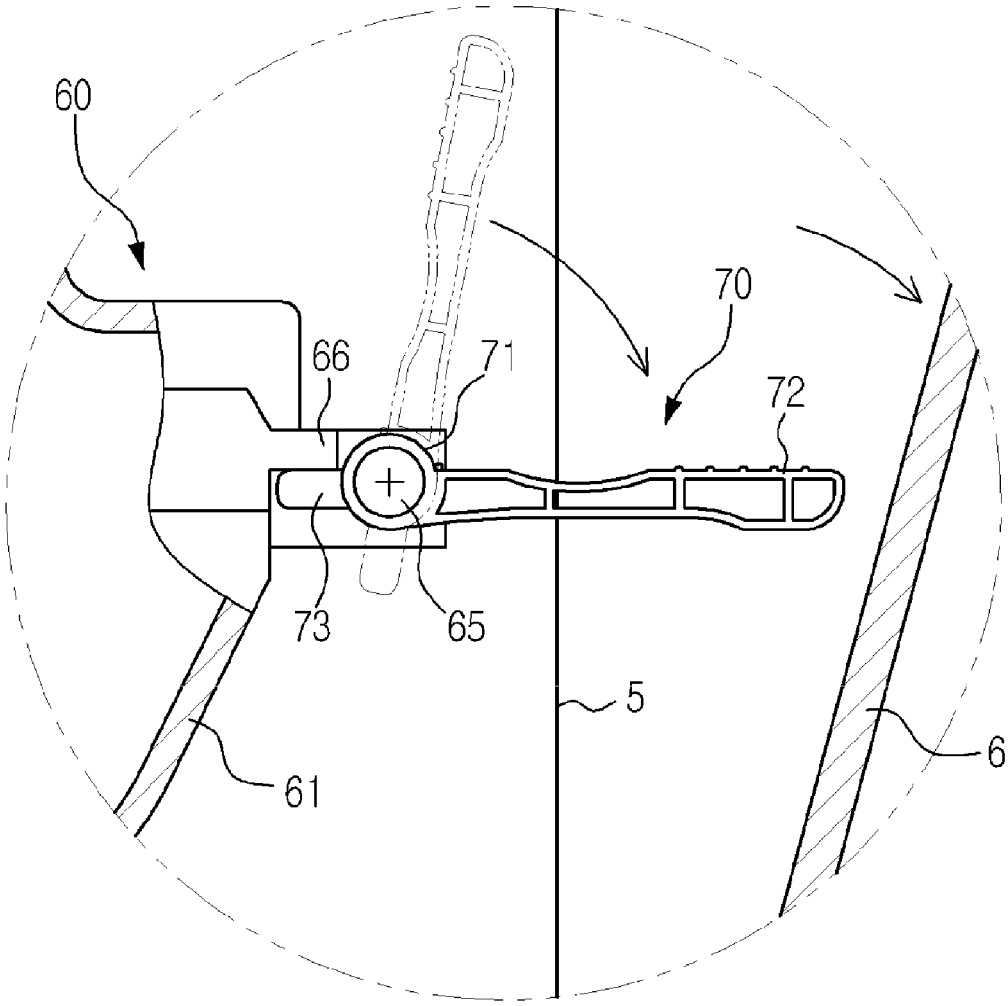
FIG. 4 is a detailed view of the C portion in FIG. 1 when the cover is in the opened state.

As shown in FIG. 3, when closing the cover 6 after installing the process cartridge unit 60 in the main body 1, the knob 70 is pushed by the inner surface of the cover 6, and rotates upward to fold inward toward the container 61. As shown in FIG. 4, when opening the cover 6 to remove the process cartridge unit 60 from the main body 1, the knob 70 rotates downward by the knob 70's own weight to unfold out away from the container 61. When the knob 70 is unfolded, the stopper portion 73 is caught by a latching portion 66 of the container 61 to keep the grip portion 72 in a substantially horizontal state, and the grip portion 72 unfolds toward the exterior of the main body 1 through the opening 5. Accordingly, the user can grasp the gripping portion 70 in the exterior of the main body 1 and remove the process cartridge unit 60 from the main body 1.

As described above, since the knobs 70 of the process cartridge unit 60 rotate vertically to fold or unfold by the opening/closing of the cover 6, the mounting space of the process cartridge unit 60 in the main body 1 can be minimized. The above-structured knobs 70 can minimize the amount of space occupied by the process cartridge unit 60 in the main body 1. Accordingly, the size of the main body 1 can also be decreased. Further, since the knobs 70 unfold automatically by their own weight when opening the cover 6 and fold by being pushed by the inner surface of the cover 6 when closing the cover 6, no additional manipulation to fold or unfold the knobs 70 is necessary.

Figure 5:
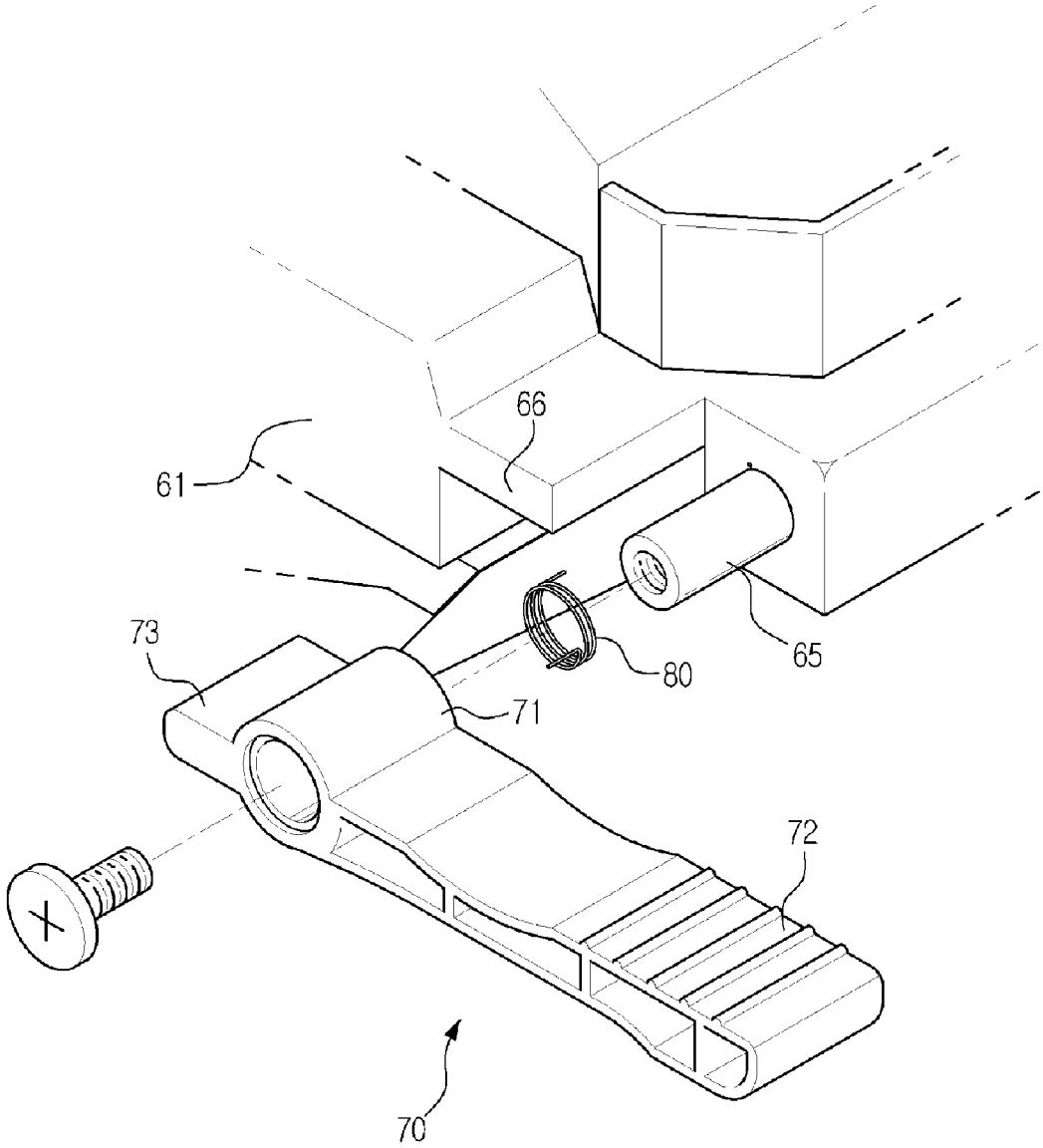
FIGS. 5 and 6 are perspective views illustrating different elastic members employed in the process cartridge unit according to other example embodiments of the present invention.
Figure 6:
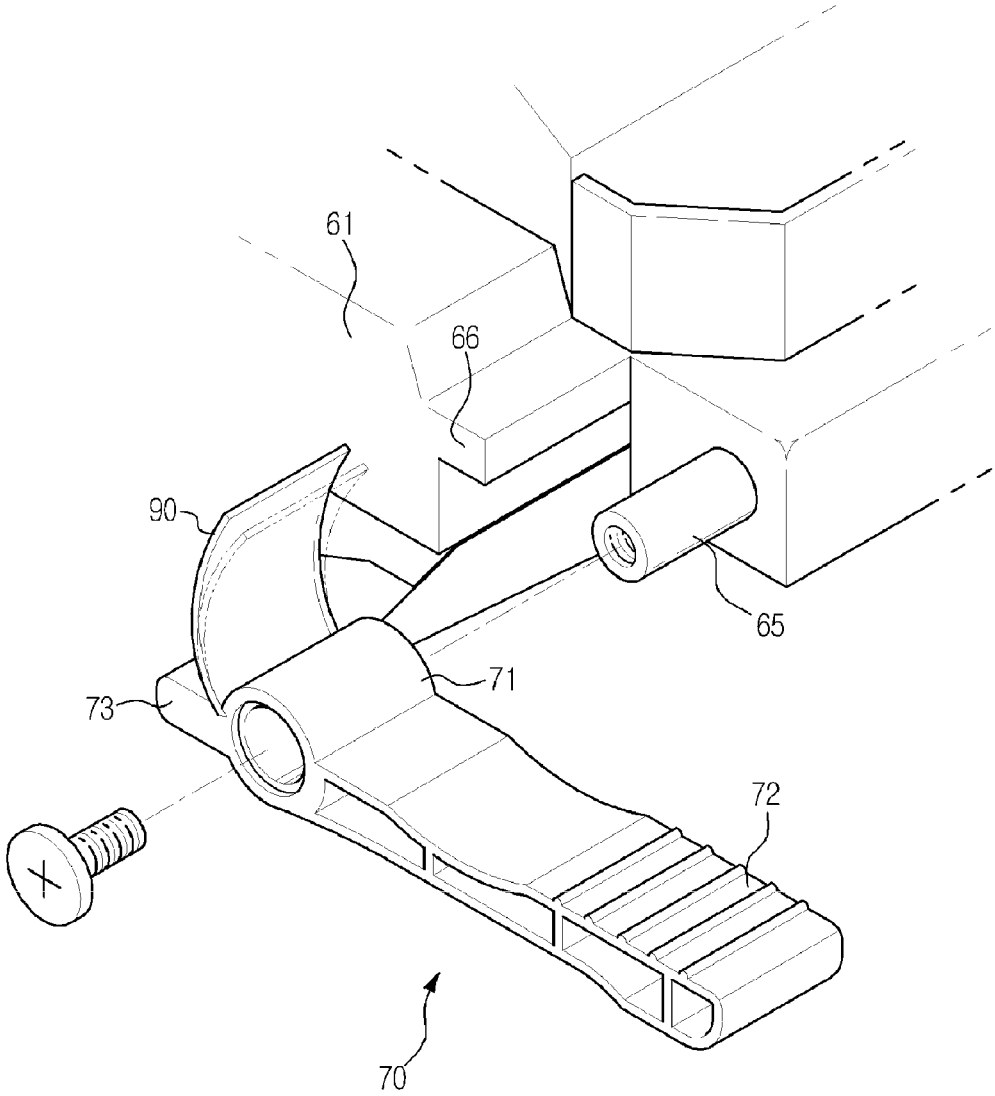

As shown in FIG. 4, the knobs 70 can be configured to unfold by their own weight when opening the cover 6. In order to make the knobs 70 unfold more smoothly, as shown in FIGS. 5 and 6, an elastic member is mounted to the shaft coupling portion 71 of each of the knobs 70. In the example embodiment shown in FIG. 5, a torsion spring 80 is mounted to the shaft coupling portion 71 of each of the knobs 70. In another example embodiment shown in FIG. 6, an elastic supporting part 90 is provided at the shaft coupling portion 71 of each of the knobs 70 such that the elastic supporting part 90 extends from the knob 70 so as to be elastically deformed, and is supported by the latching portion 66 of the container 61. The elastic supporting part 90 may be formed as a part pf the knob 70. Such configurations apply a rotational force to the knob 70 in an unfolding direction of the knob 70 so that the knob 70 can unfold more easily when opening the cover 6.

When each of the knobs 70 are configured to rotate by the torsion spring 80 or the elastic supporting part 90, although the knobs 70 and the cover 6 are not disposed near the side surface of the main body 1 as shown in FIG. 1, the knobs 70 can unfold to the exterior of the main body 1. In other words, although not shown in the drawings, even when the opening for replacing the process cartridge unit 60 is provided at the upper portion of the main body 1 and the cover 6 is mounted on the upper portion of the main body 1, the knobs can rotate to unfold out to the exterior of the main body 1 through the opening when the cover 6 is opened.

Figure 7:
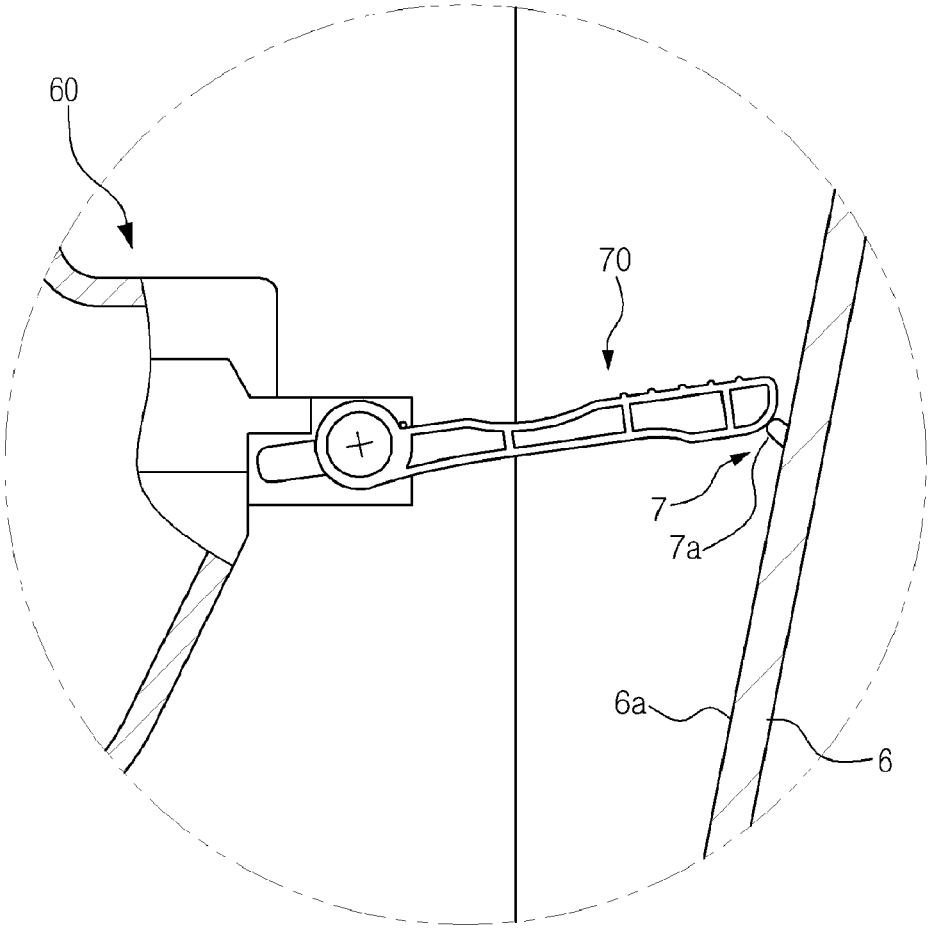
FIG. 7 is a view illustrating a partial constitution of an image forming apparatus according to another example embodiment of the present invention.

FIG. 7 is a view illustrating a partial constitution of an image forming apparatus in accordance with another embodiment of the present invention. As shown in FIG. 7, the cover 6 may include a guide part 7 to guide the folding operation of the knob 70. The guide part 7 guides the knob 70 to be smoothly rotated and folded while the cover 6 is closed. When the cover 6 is contacted with the front end portion of the knob 70 as shown by the imaginary line in FIG. 3, the knob 70 is likely not to be smoothly rotated due to friction between the cover 6 and the knob 70. The guide part 7 of this embodiment slightly pushes up the front end portion of the knob 70 when the cover 6 is closed, thereby securing the smooth folding operation of the knob 70.

The guide part 7 may include a guide protrusion 7*a* that is protruded from an inner surface 6*a* of the cover 6. The guide protrusion 7*a* is formed such that when the cover 6 is closed, the knob 70 is first contacted with the guide protrusion 7*a* before being contacted with the inner surface 6*a* of the cover 6.

It has been explained in this embodiment that the guide part 7 has a protrusion shape, however the guide part 7 is not limited to the protrusion shape. The guide part 7 may have any other structure capable of guiding the folding operation of the knob 70 by pushing up the front end portion of the knob 70.

Figure 8:
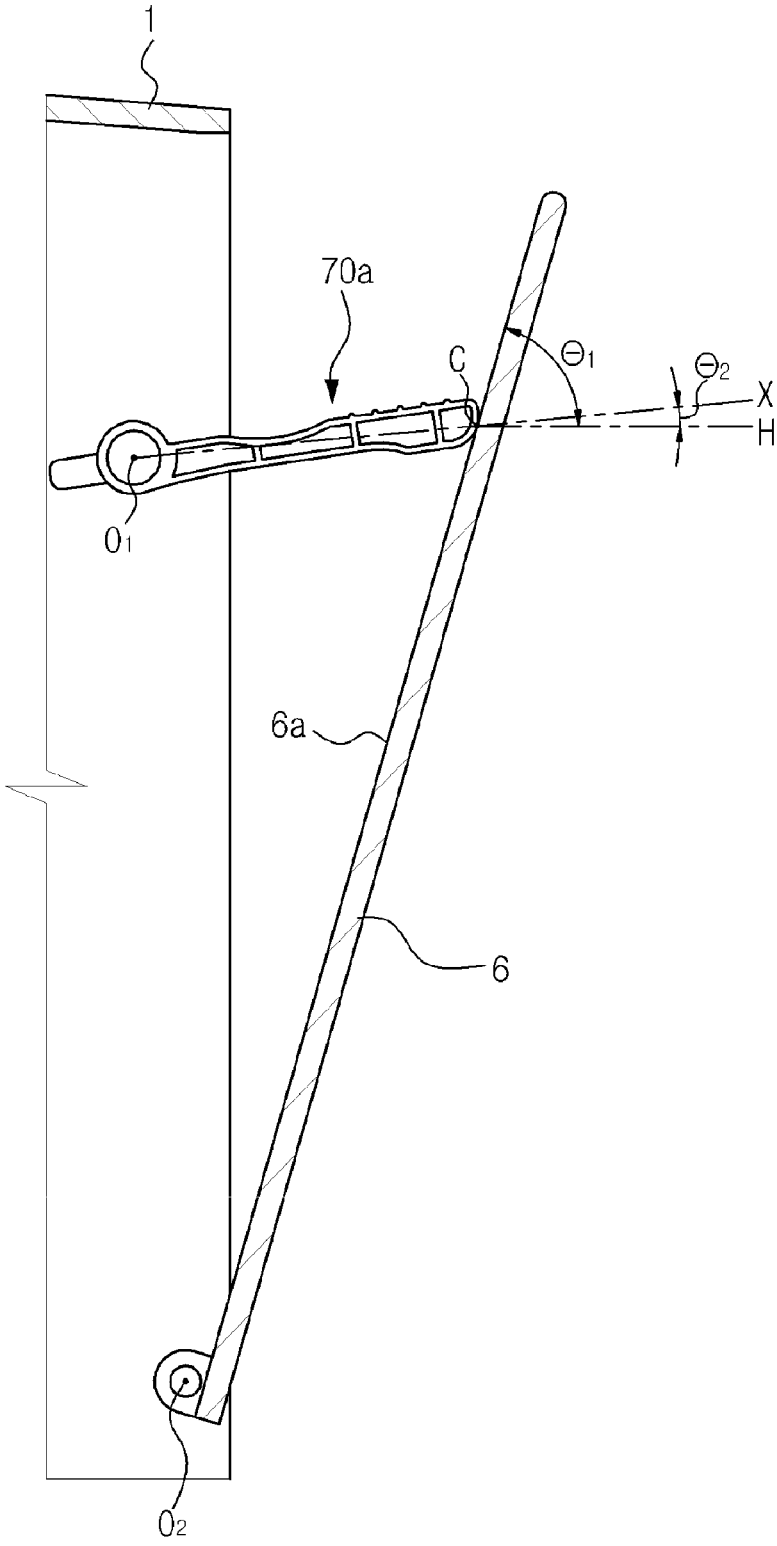
FIG. 8 is a view illustrating a partial constitution of an image forming apparatus according to a further example embodiment of the present invention.

FIG. 8 is a view illustrating a partial constitution of an image forming apparatus in accordance with a further embodiment of the present invention. In FIG. 8, a frame of the process cartridge unit is not illustrated, but a knob 70*a* is illustrated.

As shown in FIG. 8, the knob 70*a* of the process cartridge unit may be mounted to be inclined upward in an outward direction of the main body 1. The knob 70*a* inclined upward thus can be more smoothly folded at the moment the knob 70*a* is contacted with the cover 6.

So as for the knob 70*a* to be smoothly folded by the cover 6 at the moment the knob 70*a* is contacted with the cover 6 as shown in FIG. 8, an angle ($\alpha$) made by a line (X) from a rotational center ($O_1$) of the knob 70*a* to a contact point (C) between the knob 70*a* and the cover 6 and the inner surface 6*a* of the cover 6 from a rotational center ($O_2$) of the cover 6 to the contact point (C) should be set less than 90 degrees.

In a state as shown in FIG. 8, if an angle of the cover 6 with respect to a horizontal direction (H) is referred to as $\theta_1$ and an angle of the line (X) with respect to the horizontal direction (H) is referred to as $\theta_2$, the angle ($\alpha$) is a difference between the angle ($\theta_1$) and the angle ($\theta_2$) (i.e., $\alpha=\theta_1-\theta_2$).

The smaller the angle ($\alpha$) is, the knob 70*a* can be more smoothly folded. Therefore, it is preferred that the angle ($\theta_1$) is set to be as small as possible or the angle ($\theta_2$) is set to be as large as possible. However, in order to reduce the angle ($\theta_1$), the knob 70*a* should be protruded long in the outward direction of the main body 1. Accordingly, it is structurally preferred that the angle ($\theta_2$) is set to be as large as possible, instead of reducing the angle ($\theta_1$).

The increase in the angle ($\theta_2$) means the increase in a degree of upward inclination of the knob 70*a*. However, if only the mounting angle of the knob 70*a* is arbitrarily adjusted without consideration of the mounting (or removing) angle of the process cartridge unit, a user may have some trouble in mounting or removing the process cartridge unit by grasping the knob 70*a*, due to a large difference between the mounting angle of the knob 70*a* and the mounting (or removing) angle of the process cartridge unit.

For example, if the process cartridge unit is designed to be mounted or removed in the horizontal direction and the knob 70*a* is mounted at a large inclination angle with respect to the horizontal direction, a user cannot easily mount or remove the process cartridge unit. Further, because a direction of a force that a user applies to the process cartridge unit by grasping the knob 70*a* is considerably misaligned from the removing direction of the process cartridge unit (i.e., horizontal direction), a user should apply a force larger than necessary to the process cartridge unit when she/he intends to remove the process cartridge unit from the image forming apparatus.

Figure 9:
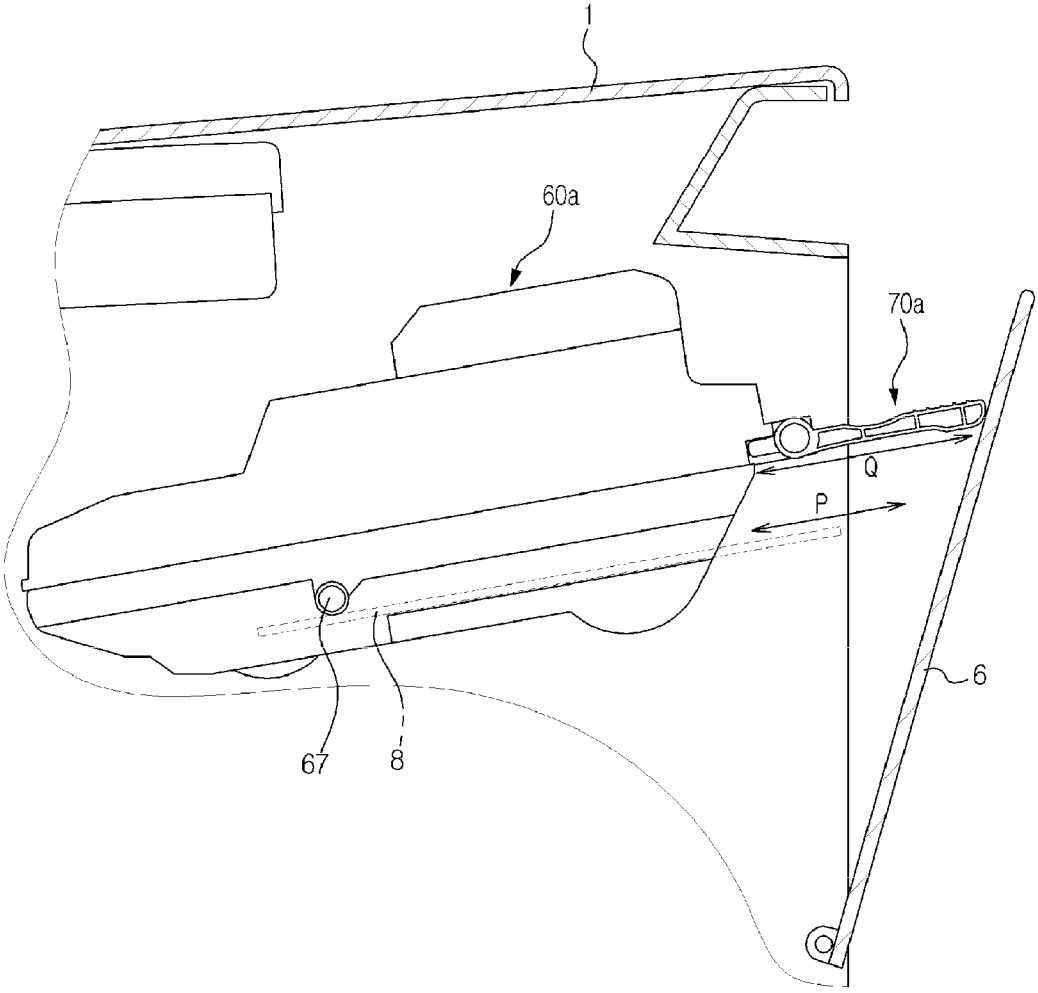
FIG. 9 is a view explaining a relation between a mounting direction of the process cartridge unit and a mounting angle of a knob according to the present invention.

In this regard, as shown in FIG. 9, it is preferred that the process cartridge unit 60*a* is mounted at a predetermined inclination angle in the main body 1 and the knob 70*a* is mounted substantially parallel to the mounting direction of the process cartridge unit 60*a*. A line (P) in FIG. 9 denotes the mounting direction of the process cartridge unit 60*a*, i.e., the direction in which the process cartridge unit 60*a* is mounted into or removed from the main body 1. A line (Q) in FIG. 9 denotes the mounting direction of the knob 70*a*. It is also possible to incline the knob 70*a* a little bit upward from the mounting direction of the process cartridge unit 60*a*, so as to secure the more smooth folding operation of the knob 70*a*.

The main body 1 may be provided with guide rails 8 to guide the installation or removal of the process cartridge unit 60*a*. The guide rail 8 may be respectively provided on both inner side surfaces of the main body 1. A reference numeral 67 denotes guide protrusions of the process cartridge unit 60*a*, which are guided by the guide rails 8. The guide protrusions may be respectively provided on both side surfaces of the process cartridge unit 60*a*.

As such, if the guide rails 8 are provided at the main body 1, the mounting (or removing) direction of the process cartridge unit 60*a* is determined by an inclination angle of the guide rails 8. Therefore, it is preferred that the knob 70*a* of the process cartridge unit 60*a* is mounted substantially parallel to the guide rails 8.

As apparent from the above description, the process cartridge unit according to aspects of the present invention can minimize a bulk of the process cartridge unit in a mounted state to the image forming apparatus, because when closing the cover of the main body the knobs rotate to fold, and when opening the cover of the main body the knobs rotate to unfold. Accordingly, a size of the main body of the image forming apparatus can also be decreased.

Further, since the knobs of the process cartridge unit unfold out to the exterior of the main body through the opening by only the manipulation of opening the cover, the user can easily grasp the knobs of the process cartridge unit.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. For example, the paper supply unit, feed unit, and the fusing unit shown in FIG. 1 may be part of the image forming unit also shown in FIG. 1. Accordingly, it is intended, therefore, that the present invention not be limited to the various example embodiments disclosed, but that the present invention includes all embodiments falling within the scope of the appended claims.

What is claimed is:

1. A process cartridge unit of an image forming apparatus, the process cartridge unit comprising:

a container to store a developer; and at least one knob coupled to the container;

wherein, when a cover of the image forming apparatus is closed to shield an opening provided in the image forming apparatus, the knob is folded by the cover, and when the cover is opened, the knob is unfolded; and wherein the process cartridge unit is removably mounted in the image forming apparatus so as to be installed or removed through the opening provided in the image forming apparatus.

2. The process cartridge unit according to claim 1, wherein when the cover is opened, the knob unfolds through the opening to the exterior of the image forming apparatus.

3. The process cartridge unit according to claim 1, wherein:

the knob is pivotably coupled to the container; and when the cover is opened, the knob rotates to unfold by the knob's own weight.

4. The process cartridge unit according to claim 1, wherein:

the knob is provided with a shaft coupling portion pivotably coupled to the container; and the shaft coupling portion is provided with an elastic member so as to rotate the knob in an unfolding direction.

5. The process cartridge unit according to claim 1, wherein the knob is provided at each of two side portions of the container.

6. The process cartridge unit according to claim 1, wherein the knob is provided with a guide surface to guide a sliding motion of the knob with respect to the cover.

7. The process cartridge unit according to claim 1, wherein the knob is mounted to be inclined with respect to a horizontal direction.

8. An image forming apparatus comprising:

a main body;

a process cartridge unit removably mounted in the main body and including a container to store a developer for forming an image onto a printable medium and at least one knob coupled to the container;

an opening provided in the main body to permit the process cartridge unit to be installed or removed; and a cover rotatably mounted to the main body so as to expose or shield the opening;

wherein when the cover is closed, the knob is folded by the cover, and when the cover is opened, the knob is unfolded.

9. The image forming apparatus according to claim 8, wherein when the cover is opened, the knob is unfolded to the exterior of the opening.

10. The image forming apparatus according to claim 8, wherein:

the knob is pivotably coupled to the container; and when the cover is opened, the knob rotates to unfold by the knob's own weight.

11. The image forming apparatus according to claim 8, wherein:

the knob is provided with a shaft coupling portion pivotably coupled to the container; and the shaft coupling portion is provided with an elastic member to rotate the knob in an unfolding direction.

12. The image forming apparatus according to claim 8, wherein knobs are provided at each of two side portions of the container.

13. The image forming apparatus according to claim 8, wherein the cover is provided with a guide part to push up an end portion of the knob.

14. The image forming apparatus according to claim 8, wherein the knob is mounted to be inclined upward in an outward direction of the main body.

15. The image forming apparatus according to claim 8, wherein the knob is mounted substantially parallel to a direction in which the process cartridge unit is mounted or removed into/from the main body.

16. A process cartridge unit mounted in an image forming apparatus including a main body and a cover hingedly coupled to the main body, the process cartridge unit comprising:

a frame; and at least one knob rotatably mounted to the frame, the knob being rotated interlockingly with opening/closing operation of the cover.

17. The process cartridge unit according to claim 16, wherein the knob is mounted to be inclined with respect to a horizontal direction.

18. The process cartridge unit according to claim 16, wherein the knob has a contact point which is contacted with the cover when the cover is closed, and wherein an angle (a) made by a line from a rotational center of the knob to the contact point and the cover contacted with the knob is less than 90 degrees.

19. An image forming apparatus comprising:

a main body having an opening;

a cover to expose or shield the opening; and a process cartridge unit mounted in the main body through the opening, the process cartridge unit including at least one knob which is rotated interlockingly with opening/closing operation of the cover.

20. The image forming apparatus according to claim 19, wherein the process cartridge unit is mounted in the main body at a predetermined inclination angle with respect to a horizontal direction.

21. The image forming apparatus according to claim 19, wherein the main body is provided with a guide rail to guide the process cartridge unit, and wherein the knob is mounted substantially parallel to the guide rail.

22. The image forming apparatus according to claim 19, wherein the knob has a contact point which is contacted with the cover when the cover is closed, and wherein an angle ($\alpha$) made by a line from a rotational center of the knob to the contact point and the cover contacted with the knob is less than 90 degrees.

23. A process cartridge unit for an image forming apparatus, the process cartridge unit comprising:

a container to store a developer; and at least one knob coupled to the container and arranged so as to automatically fold into the image forming apparatus and unfold out of the image forming apparatus as an opening in the image forming apparatus closes and opens;

wherein the process cartridge unit is arranged so as to be removably installed in the image forming apparatus.

24. An image forming apparatus comprising:

a main body including an opening and a cover arranged so as to cover and uncover the opening;

an image forming unit installed within the main body to form an image onto a printable medium; and a process cartridge unit removably installed within the main body, via the opening, to supply developer to the image forming unit, and including a container to store the developer and at least one knob arranged so as to fold up inside the main body while the cover is covering the opening and to unfold out of the main body while the cover is uncovering the opening.

25. The image forming apparatus according to claim 24, wherein the process cartridge unit further comprises:

a shaft to which the knobs are rotatably coupled; and a latching member coupled to the container to restrict movement of the knobs.

26. The image forming apparatus according to claim 25, wherein each of the knobs further comprise:

a shaft coupling unit rotatably coupled to the shaft;

a gripping member extending from the shaft coupling unit to be gripped by a user; and a stopping member coupled to the shaft coupling unit to engage with the latching member as the knob unfolds so as to restrict the unfolding of the knob beyond a predetermined amount.

27. The image forming apparatus according to claim 24, wherein:

when the cover is covering the opening, the knobs fold into the main body by a force from the cover; and when the cover is uncovering the opening, the knobs unfold out of the main body by the knobs' own weight.

* * * * *